US005544452A

United States Patent [19]

Fujita et al.

[11] Patent Number: 5,544,452

[45] Date of Patent: Aug. 13, 1996

[54] METHOD OF AND APPARATUS FOR DAMPING THE VIBRATION OF A BUILDING

[75] Inventors: Takafumi Fujita, Nagareyama; Ikuo Shimoda; Masami Mochimaru, both of Fujisawa; Susumu Otsuka, Osaka; Nobuyasu Kawai, Osaka; Kurimoto Kurimoto, Osaka; Kanemasa Inaba, Osaka, all of Japan

[73] Assignees: Oiles Corporation, Tokyo; Okumura Corporation, Osaka, both of Japan

[21] Appl. No.: 269,605

[22] Filed: Jul. 5, 1994

[30] Foreign Application Priority Data

Jul. 7, 1993 [JP] Japan ..... 5-193186

[51] Int. Cl.[6] ..... E04H 9/02; E04B 1/98

[52] U.S. Cl. ..... 52/167.2; 52/167.1

[58] Field of Search ..... 52/167.1, 167.2, 52/167.4, 167.5, 167.6

[56] References Cited

U.S. PATENT DOCUMENTS

| | | | |
|---|---|---|---|
| 2,035,143 | 3/1936 | Cavaglieri | 52/167.6 |
| 5,046,290 | 9/1991 | Ishit et al. | 52/167.2 |
| 5,255,764 | 10/1993 | Kurabayashi et al. | 52/167.2 |
| 5,421,129 | 6/1995 | Sakamoto et al. | 52/167.2 |

FOREIGN PATENT DOCUMENTS

| | | | |
|---|---|---|---|
| 3076974 | 4/1991 | Japan | 52/167.4 |
| 3169984 | 7/1991 | Japan | 52/167.5 |
| 4-161678 | 6/1992 | Japan . | |
| 4254677 | 9/1992 | Japan | 52/167.2 |
| 5065775 | 3/1993 | Japan | 52/167.4 |

*Primary Examiner*—Michael Safavi
*Attorney, Agent, or Firm*—Nixon & Vanderhye

[57] ABSTRACT

A passive vibration-damping unit in which movable upper members with a weight mounted thereon are superposed on fixed lower members with roller members interposed therebetween is installed in a highest story of a high-rise building. An active vibration-damping unit for actively causing the movable upper members of the passive vibration-damping unit to move in a shaking manner by means of a servo motor is incorporated in the passive vibration-damping unit. When the vibration of the building has occurred, the weight is allowed to move forcibly in the vibration-damping direction by means of the active vibration-damping unit. When the vibration has reached a limit value of the relative displacement of the active vibration-damping unit or a limit value of the torque of the servo motor, only the operation of the passive vibration-damping unit is continued. When the vibration has subsided to a certain extent, the active vibration-damping unit is operated again.

3 Claims, 6 Drawing Sheets

METHOD OF AND APPARATUS FOR DAMPING THE VIBRATION OF A BUILDING

BACKGROUND OF THE INVENTION

1. Field of the Invention

The present invention relates to a method of and an apparatus for damping the vibration of a building caused by an earthquake and strong wind pressure.

2. Description of the Related Art

In high-rise buildings, the period of vibration caused by an earthquake or strong wind pressure is long, and swaying motion still continues for a while even after the earthquake or the strong wind has substantially subsided, imparting a sense of uneasiness or fear to the occupants of the building. In recent years, therefore, vibration damping apparatuses, which are adapted to operate with a period coinciding with the period of natural vibration of the building as a whole, have come to be installed in highest stories of high rise buildings where the amplitude of vibration is the largest.

As such a vibration damping apparatus, a vibration damping apparatus has been developed which is constructed such that roller members are interposed between a pair of upper and lower clamping members whose opposing surfaces are formed with circular arcuate cross sections, respectively, the lower clamping member being fixed on a highest story of a high-rise building, and a weight being mounted on the upper clamping member, as disclosed in Japanese Patent Application No. 161678/1992. According to this vibration damping apparatus, when the building is subjected to vibration due to an earthquake or the like, the weight vibrates in the same direction with a phase lag of a predetermined period, and the upper clamping member supporting the weight sways over the circular arcuate surface of the lower clamping member via the roller members, thereby making it possible to suppress the vibration of the building by absorbing the vibrational energy of the building.

However, since the above-described vibration damping apparatus is capable of operating only passively in synchronism with the primary natural period of the building, although the effect of suppressing the vibration in the primary mode is large, the vibration damping apparatus is difficult to respond to quick vibration in a higher mode. Moreover, since the apparatus is operated only after the building has swayed, there is a drawback in that it is difficult to suppress large vibrations in an early period. In addition, when the vibration of the building becomes large, there is the risk that the upper clamping member with the weight mounted thereon may become dislocated from the lower clamping member, rendering the apparatus itself inoperable and possibly causing damage to the apparatus and the building.

For this reason, so-called active vibration-damping apparatuses have been developed in which an actuator is connected between the weight of such a passive vibration damping apparatus and a building, the magnitude of the vibration of the building is detected by a sensor, and the operation of the actuator is controlled in correspondence with the detected amount thereof. However, since, when the vibration of the building has become large, as described above, and exceeded the capacity of the apparatus, the actuator is stopped to ensure the safety of the apparatus, there is a drawback in that the overall vibration damping apparatus becomes integrated with the building, and fails to demonstrate the vibration-damping effect.

SUMMARY OF THE INVENTION

Accordingly, an object of the present invention is to provide a method of damping the vibration of a building which makes it possible to overcome the above-described problems as well as an apparatus for implementing the method.

To this end, in accordance with a first aspect of the present invention, there is provided a method of damping the vibration of a building, comprising the steps of: providing a passive vibration-damping unit including a lower member fixed integrally on a building, and a weight mounted on said upper member relatively movable in a vibrating direction of the building, an amount of movement of said weight being restricted by a stopper member or the like in a range in which said weight is not dislocated from said lower member, and an active vibration-damping unit for moving said weight of said passive vibration-damping unit in a damping direction with respect to said lower member; operating said active vibration-damping unit with a control force corresponding to the velocity of the vibration and displacement of the building when the building is vibrated; and stopping the operation of said active vibration-damping unit and operating only said passive vibration-damping unit when relative displacement of said active vibration-damping unit with respect to the vibration or a torque of said motor has reached a limit value.

In a second aspect of the present invention, in the above-described method of damping the vibration of a building in accordance with the first aspect of the invention, the active vibration-damping unit is operated again when the vibration of the building reaches a state in which the relative displacement of the active vibration-damping unit or the torque of the motor is below a limit value and when continuous active damping is possible.

In a third aspect of the present invention, there is provided an apparatus for damping the vibration of a building, comprising: a passive vibration-damping unit including a lower member fixed on a building and having on its upper surface an upwardly-oriented concave arcuate surface, an upper member having on its lower surface a downwardly-oriented concave arcuate surface, said upper member being placed on the upwardly-oriented concave arcuate surface of said lower member with a roller member interposed therebetween, such that said upper member is capable of moving in a shaking manner, a weight mounted on said upper member, and a stopper member provided at each opposite end of said lower member for restricting the shaking range of said upper member; an active vibration-damping unit including a motor fixed to the building or said lower member, a ball screw disposed horizontally in a vibrating direction of the building, said ball screw being rotated by an activation of said motor, and a connecting member having a nut member meshing with said ball screw, said connecting member being engaged with said upper member in such a manner as to be capable of undergoing relative movement in a vertical direction; a vibration detecting sensor disposed at an appropriate position in the building and a movable section of said passive vibration-damping unit; and a control circuit for computing an optimum damping speed on the basis of values of measurement from said vibration detecting sensor so as to drive said motor of said active vibration-damping unit in a vibration suppressing direction.

When the vibration of a building has occurred by an earthquake or strong wind pressure, the quantities of state of the building and the active vibration-damping unit are detected, and the active vibration-damping unit is operated with an optimum speed corresponding to the state of vibration of the building. If the vibration of the building is very large, and the relative displacement of the active vibration-damping unit with respect to the vibration has reached a limit, the operation of this active vibration-damping unit is stopped to ensure the safety of the apparatus as a whole, and the operation of the passive vibration-damping unit is continued to suppress the vibration of the building passively.

The active vibration-damping unit is arranged such that the motor is fixed to the building or the lower members, the ball screw is disposed horizontally along the vibrating direction of the building, the ball screw being rotated by the motor, and the connecting member has the nut member meshing with the ball screw and is engaged with the upper member in such a manner as to be capable of undergoing relative movement in a vertical direction. Accordingly, even if the operation of the active vibration-damping unit is stopped, the nut member connected to the passive vibration-damping unit is capable of moving along the ball screw while rotating the ball screw. Hence, the passive vibration-damping unit operates smoothly in the direction of suppressing the vibration of the building with the active vibration-damping unit set in a no-load state.

Furthermore, although the upper member of the passive vibration-damping unit with the weight mounted thereon tends to be dislocated from the lower member fixed to the building due to the large vibration of the building, since the stopper member is provided at each opposite end of the lower member for restricting the shaking range of the upper member, the movable section of the passive vibration-damping unit moves in a shaking manner in the damping direction without being dislocated from the lower member.

In addition, in accordance with the present invention, since the active vibration-damping unit is operated again when the relative displacement of the active vibration-damping unit with respect to the vibration or the torque of the motor has dropped below the limit value and when continuous active damping is possible, the vibration damping apparatus is capable of demonstrating positive and effective damping operation until the vibration of the building subsides.

The above and other objects, features and advantages of the present invention will become more apparent from the following detailed description of the invention when read in conjunction with the accompanying drawings.

DESCRIPTION OF THE PREFERRED EMBODIMENT

Figure 5:
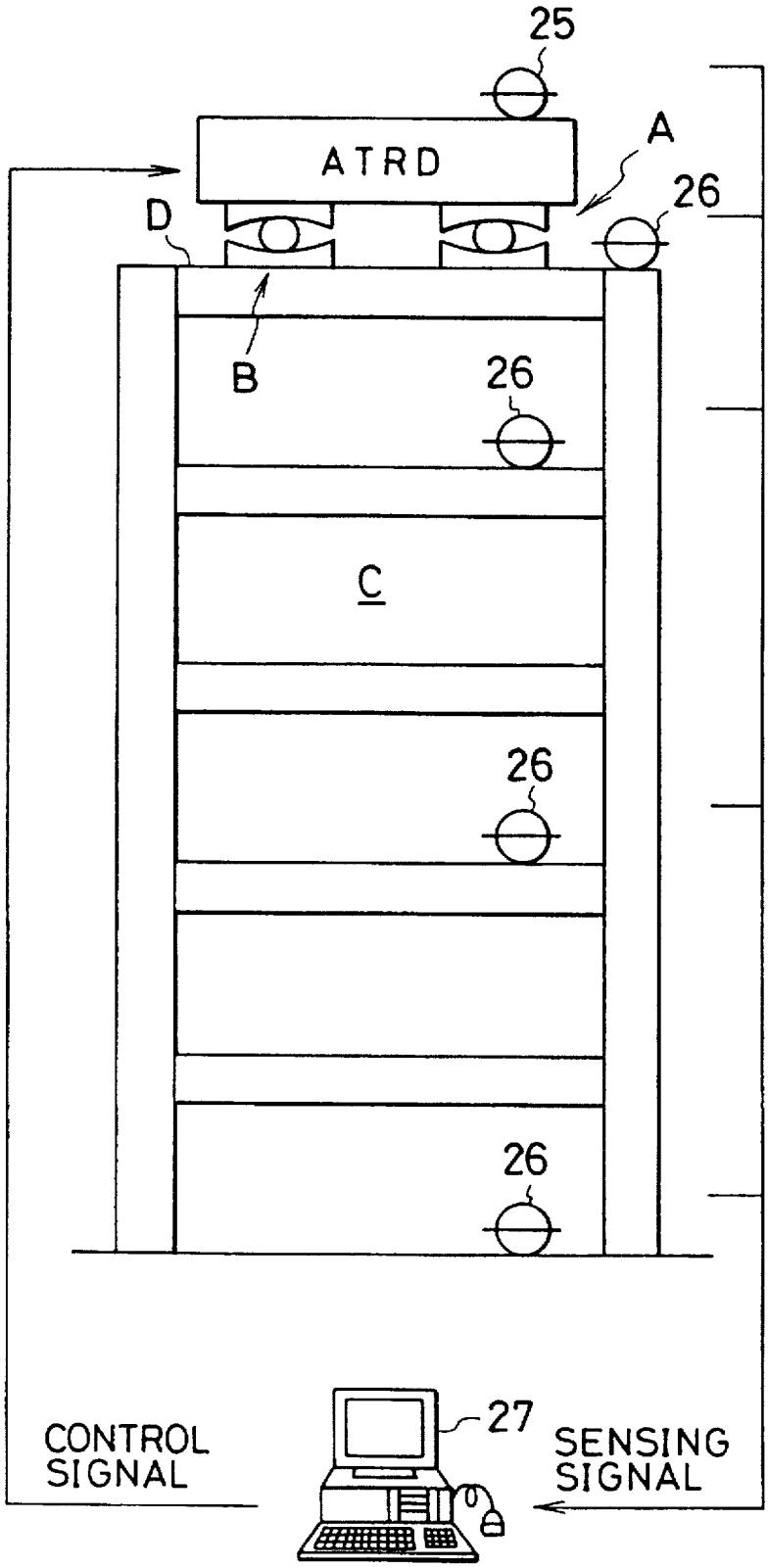
FIG. 5 is a schematic overall diagram of a building with the vibration damping apparatus installed therein.

In FIGS. 1 to 4, the vibration damping apparatus is comprised of a passive vibration-damping unit A and an active vibration-damping unit B which is incorporated integrally in the passive vibration-damping unit A. The vibration damping apparatus is installed on a central portion of a floor D of a highest story of a building C, as shown in FIG. 5. The passive vibration-damping unit A is comprised of a pair of lower members 2 which are respectively secured on both sides of a base 1 affixed to the floor D of the building C; a pair of upper members 4 respectively placed on the lower members 2 with a pair of roller members 3 interposed therebetween; and a weight 5 mounted on and affixed to the upper surfaces of the upper members 4 in a bridging state.

Figure 1:
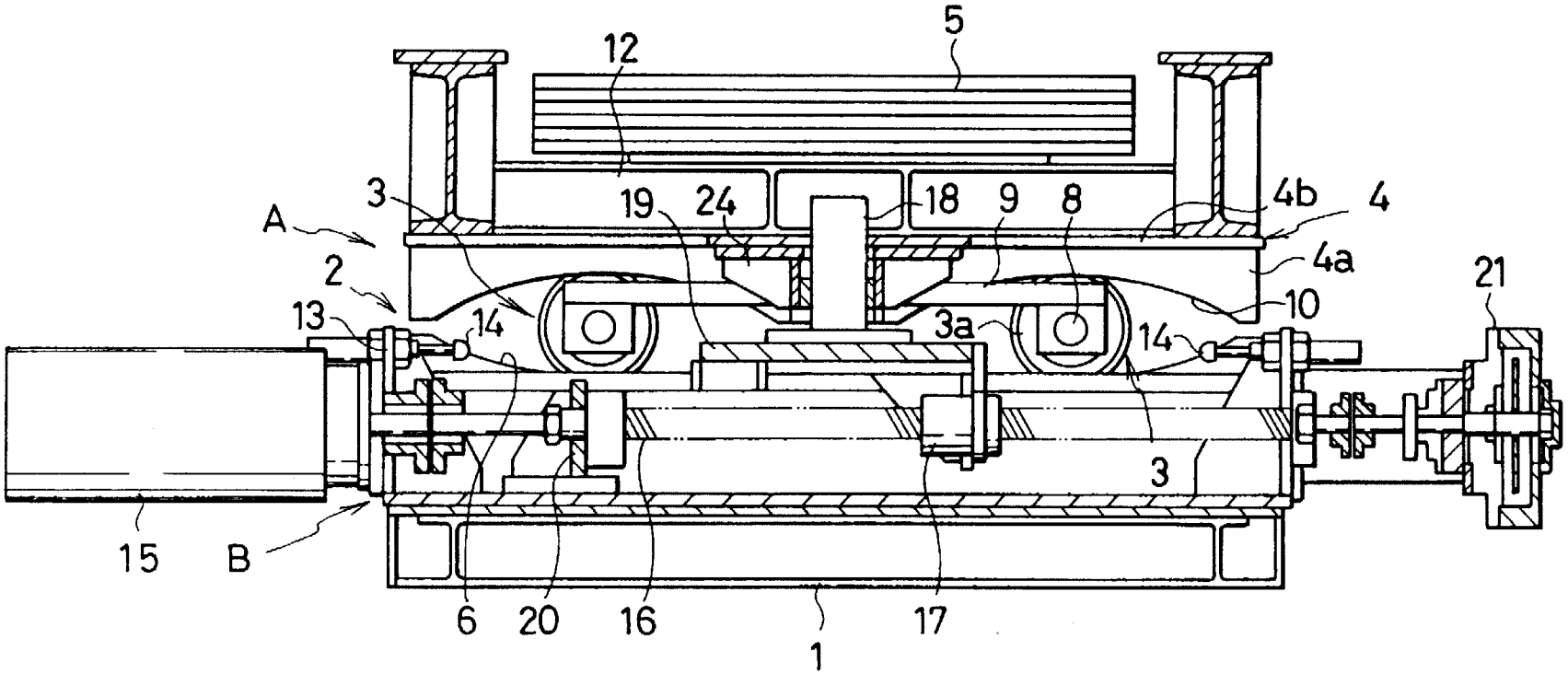
FIG. 1 is a vertical front elevational view of the vibration damping apparatus.
Figure 2:
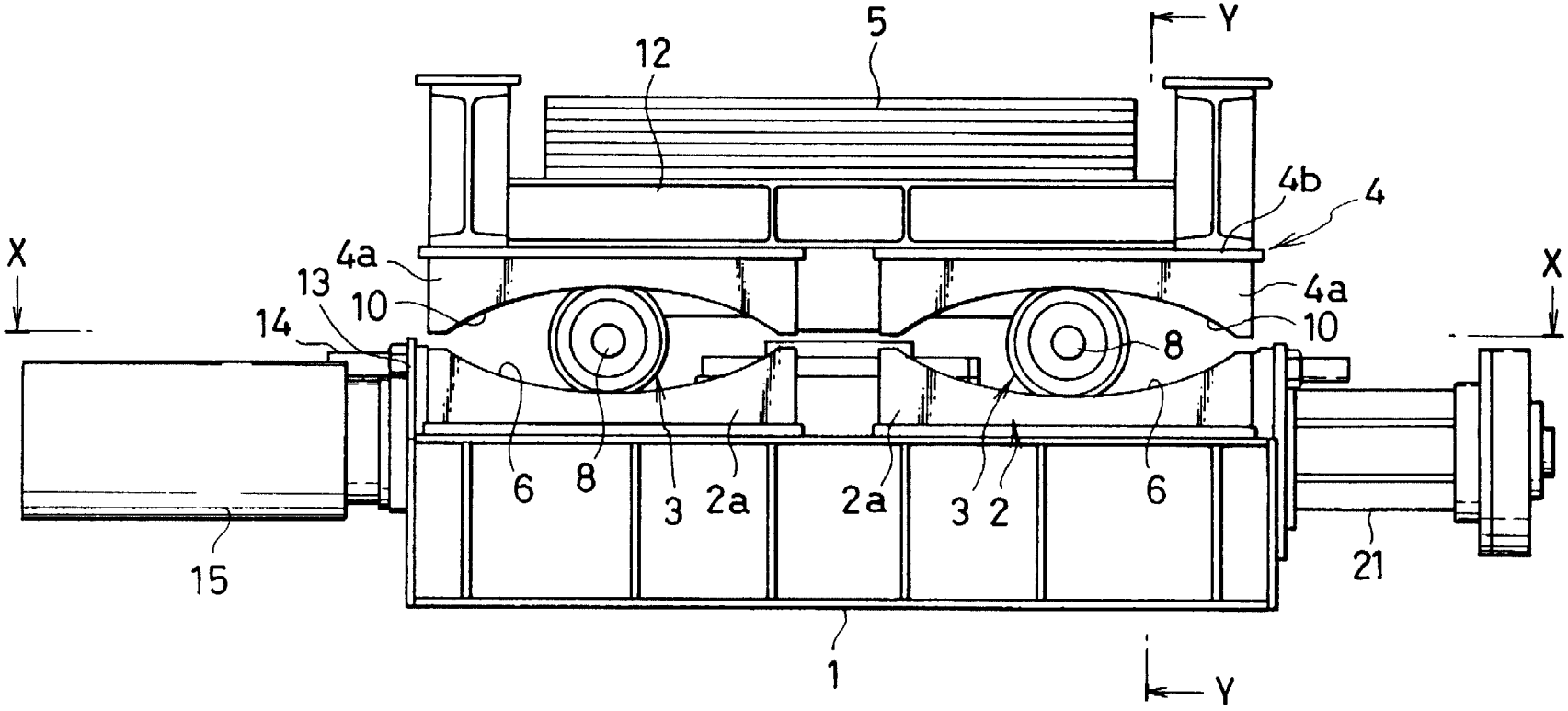
FIG. 2 is a schematic front elevational view thereof.
Figure 3:
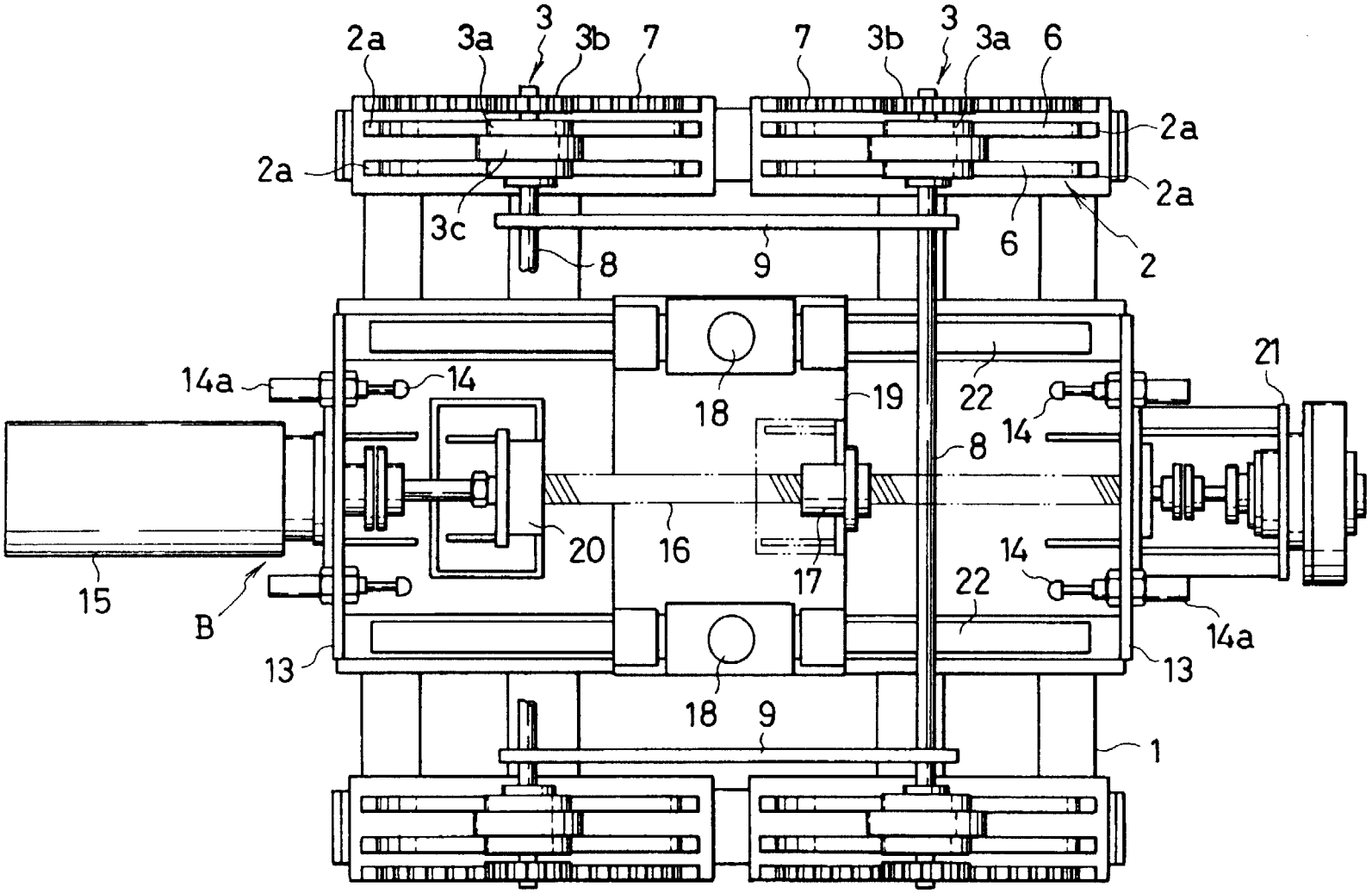
FIG. 3 is a horizontal cross-sectional view taken along line X—X in FIG. 2.
Figure 4:
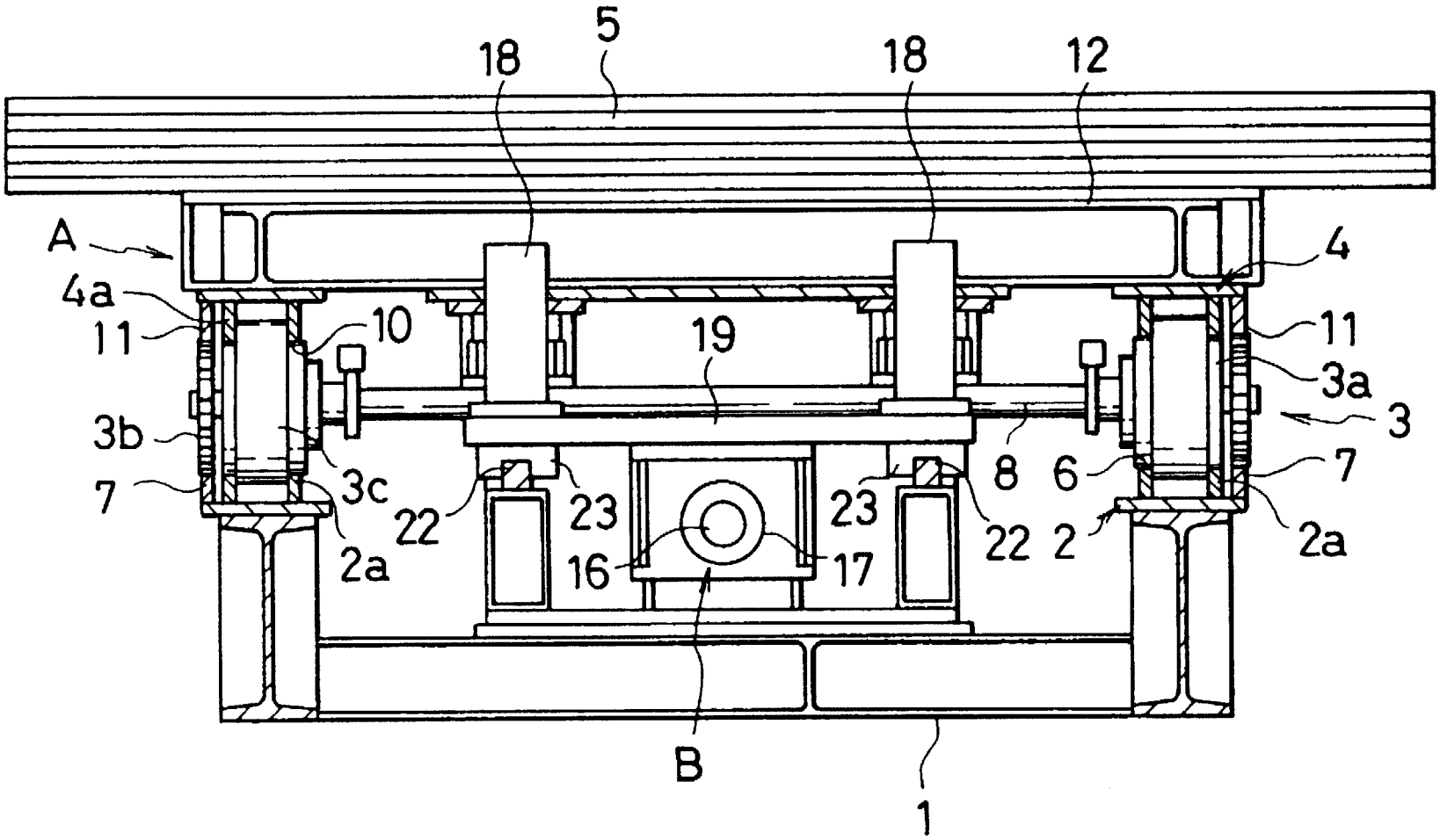
FIG. 4 is a vertical side elevational view taken along line Y—Y in FIG. 2.

Each of the pair of lower members 2 has at each opposite end thereof a pair of plate members **2*a* juxtaposed in the transverse direction, as viewed in FIG. 3, with a small interval therebetween. The upper surface of each plate member 2*a* is formed as an upwardly-oriented concave arcuate surface 6 having a predetermined radius, as shown in FIG. 2. These pairs of juxtaposed plate members 2*a* are provided uprightly and are respectively secured on the base 1 in the vicinities of the four corners thereof. A concave arcuate rack 7 having a curvature identical to that of the concave arcuate surface 6 is uprightly juxtaposed and secured to the outer side of each of the four outermost plate members 2*a*. At each opposite end of a shaft 8, each of the pair of roller members 3 has a roller 3*a* having a predetermined radius and adapted to roll on the upwardly-oriented concave arcuate surfaces 6, a pinion 3*b* meshing with the rack 7 to prevent the slippage of the roller 3*a* on the concave arcuate surfaces 6, and a large-diameter roller portion 3*c* formed in an axially intermediate portion of the roller 3*a* and inserted between the pair of juxtaposed plate members 2*a* so as to allow the roller 3*a* to roll accurately along the concave arcuate surfaces 6. These roller members 3 are respectively placed on the lower members 2 arranged side by side, and the roller members 3 are connected to each other by means of a pair of coupling members 9, so that the roller members 3 are capable of rolling integrally on the lower members 2**.

Each of the upper members 4 is arranged as follows. 0n each opposite side of the upper member 4, a pair of plate members **4*a*, each having a lower surface formed as a downwardly-oriented concave arcuate surface 10 with a curvature identical to that of the aforementioned upwardly-oriented concave arcuate surface 6, are affixed to the underside of a baseplate 4*b* in such a manner as to project downwardly in face-to-face relation to the pair of plate members 2*a* of the lower member 2. These upper members 4 are arranged side by side in face-to-face relation to the juxtaposed lower members 2 with the roller members 3 interposed therebetween. The downwardly-oriented concave arcuate surfaces 10 are placed on the roller 3*a* of the roller member 3, and the large-diameter roller portion 3*c* is inserted between the pair of plate members 4*a*. A concave arcuate rack 11 having a curvature identical to that of the rack 7 is juxtaposed and secured to the outer side of each of the four outermost plate members 4*a*, and the rack 11 is made to mesh with the pinion 3*b***.

The pair of baseplates **4*b* of the upper members 4 are secured to the underside of a frame 12 arranged in a bridging state. The weight 5 is mounted on the frame 12. In addition, a pair of fixed plates 13 are provided uprightly and secured to the base 1 at longitudinal ends thereof, respectively. Each of these fixed plates 13 is provided with a pair of stopper members 14. When the upper members 4 are move on a large scale in a shaking manner through the roller members 3, these stopper members 14 restrict the shaking range of the upper members 4 so that the upper members 4 will not be dislocated from the lower members 2. Each of these stopper members 14 is provided by facing the inner side of the apparatus in such a way as to project from a cylindrical member 14***a* in which a damping member (not shown) such as a spring is provided so as to receive one end of the member 14.

The passive vibration-damping unit A is arranged as described above, and a description will be given of the structure of the active vibration-damping unit B which is incorporated integrally in this passive vibration-damping unit A. The active vibration-damping unit B is comprised of a servo motor 15 fixed on the floor D of the building C or on one side end of the base 1 of the lower members 2; a rod-shaped ball screw 16 which is rotated by the servo motor 15; and a tabular connecting member 19 which has at a lower end thereof a nut member 17 meshing with the ball screw 16 and has at an upper end thereof a pair of pins 18 connected to the frame 12 of the upper members 4.

The ball screw 16 arranged horizontally on the base 1 at a transversely central position thereof in such a manner as to extend in the longitudinal direction in a state in which the ball screw 16 is rotatably supported by a bearing 20 provided on the base 1. The ball screw 16 has its distal end directly coupled to a rotating shaft of the servo motor 15, and its distal end is rotatably supported by an oil-filled rotating damper 21 attached to the fixed plate 13 on the opposite side. This rotating damper 21 is adapted to absorb vibrational energy occurring in the passive vibration-damping unit A through the ball screw 16 during damping operation.

In addition, a pair of guide rails 22, which are juxtaposed with the ball screw 16 placed therebetween in such a manner as to extend in the longitudinal direction of the base 1, are fixed on the base 1 at transverse sides thereof, respectively. A pair of slide members 23, which are secured to the underside of the connecting member 19 at transverse ends thereof, are respectively engaged on these guide rails 22 in such a manner as to be slidable in the longitudinal direction. The nut member 17 meshing with the ball screw 16 is integrally attached to the underside of the connecting member 19. Incidentally, the nut member 17 has on its inner peripheral surface a ball bearing fitted to the ball screw 16 so as to allow the advancing and retracting movement of the nut member 17 with respect to the ball screw 16 to be effected smoothly. The pair of pins 18 are disposed integrally with the connecting member 19 in such a manner as to project upwardly from the upper surface of the connecting member 19 at transverse positions thereof. These pins 18 are respectively fitted in a pair of bearing members 24 secured to a central portion of the frame 12 of the passive vibration-damping unit A at transverse positions thereof, in such a manner as to be vertically slidable.

In FIG. 5, a sensor 25 is disposed on the weight 5 of the passive vibration-damping unit A or at an appropriate position on the frame 12 so as to measure quantities of state (absolute velocity and displacement) of a movable side of the passive vibration-damping unit A. A plurality of sensors 26 are disposed at appropriate positions within the building C so as to measure quantities of state (absolute velocity and displacement) of the building C. A computer 27, which is installed at an appropriate position within the building C, computes output signals from the sensors 25 and 26, and transmits a control signal for suppressing the vibration to the servo motor 15 of the active vibration-damping unit B.

Figure 6:
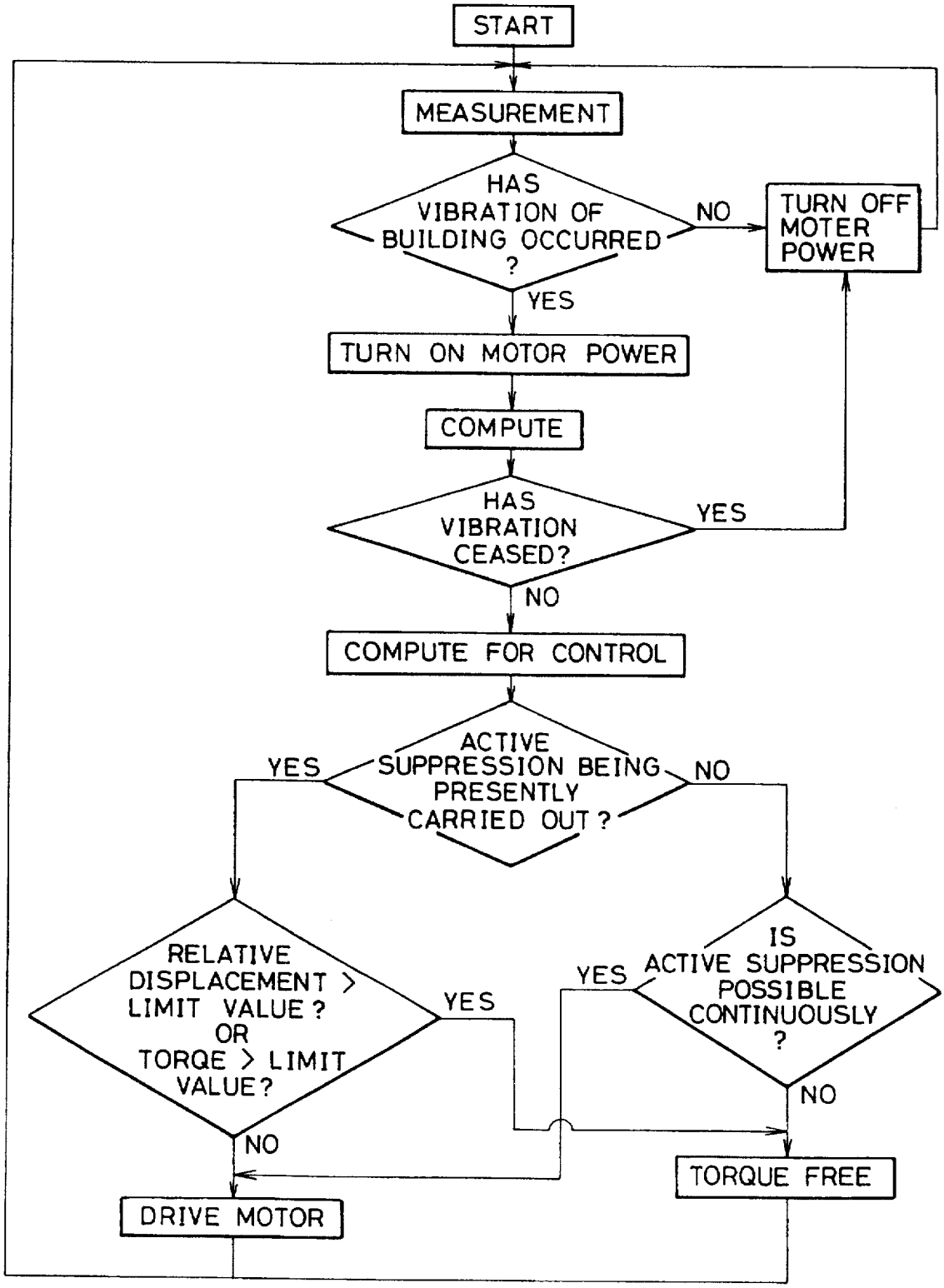
FIG. 6 is a flowchart explaining the vibration damping operation.

The vibration damping apparatus arranged as described above is installed such that the shaking direction of the upper members 4, on which the weight 5 constituting the movable section of the passive vibration-damping unit A is mounted, is oriented in the vibrating direction of the building C. In order to control the vibration in both longitudinal and transverse directions, it suffices if two of these vibration damping apparatuses are installed adjacent to each other on the central portion of the floor D of the building C or in a superposed state, and are respectively oriented such that the shaking directions of their upper members are perpendicular to each other. Hereafter, with reference to the flowchart shown in FIG. 6, a description will be given of a case where the vibration of the building C in the longitudinal direction of the apparatus is controlled.

It should be noted that the period of vibration of the weight 5 is made to coincide with the period of vibration of the entire building during the occurrence of the vibration. Accordingly, in a case where a front-side width of the building C differs from a lateral-side width thereof as in the case of a building having a horizontally rectangular cross section, the periods of natural vibration of the building C which vibrates in these directions differ. Hence, the radius of each of the concave arcuate surfaces 6, 10 of the upper and lower members 4, 2, which are oriented in correspondence with the respective vibrating direction, is set such that the period of vibration of the apparatus becomes identical to the period of natural vibration of the building C.

When values of measurement by the sensors 25, 26 are values which do not detect the vibration of the building C, the power supply of the servo motor 15 remains turned off. In the event that the building C sways in the longitudinal direction of the apparatus due to the occurrence of an earthquake or a strong wind, the power supply of the servo motor 15 is turned on. When the building C sways, the weight 5 begins to move in a shaking manner with a phase lag of a predetermined period. Namely, the weight 5 moves in a shaking manner as the downwardly-oriented concave arcuate surfaces 10 of the upper members 4 of the passive vibration-damping unit A with the weight 5 mounted thereon move relatively on the upwardly-oriented concave arcuate surfaces 6 of the fixed lower members 2 in the longitudinal direction by means of the roller members 3. Due to this shaking movement, the vibrational energy of the building C is converted to vibration energy of the weight 5, thereby suppressing the vibration of the building.

At this time, absolute values of the displacement and velocity between the building C and the upper members 4 of the passive vibration-damping unit A with the weight 5 mounted thereon, i.e., the quantities of state, are measured by the sensors 25, 26. After their quantities of state are converted by A/D conversion, the quantities of state (response value) of the building C are corrected to relative velocity and relative displacement to the foundation by the computes 27. At the same time, a relevant control mode for response is selected as the control mode, and an optimum control speed of the servo motor 15 of the active vibration-damping unit B is computed by the computer 27. Also, the overall energy (potential energy and kinetic energy) of the weight 5 is calculated.

When the overall energy is very small, and the swaying of the building C has subsided very soon, the servo motor 15 of the active vibration-damping unit B is not operated, and its power supply is turned off. On the other hand, if the vibration has not subsided, and the quantities of state at any positions of the building detected by the sensors 26 have reached fixed values or more, the control speed computed in response to the quantities of state of that vibration is subjected to D/A conversion, and is transmitted to the servo motor 15 as a command speed, thereby causing the weight 5 to actively move in the direction in which the vibration of the building C is suppressed.

Namely, when the servo motor 15 is operated in a forward rotating direction or in a reverse rotating direction in response to a speed command signal from the computer 27, the ball screw 16 is rotated by the servo motor 15, which in turn causes the connecting member 19 having the nut member 17 meshing with the ball screw 16 to move in the longitudinal direction along the ball screw 16. Consequently, the upper members 4 with the weight 5 mounted thereon, which is connected to the member 19 by means of the pins 18, are moved forcibly in the vibration damping direction by means of the roller members 3 with respect to the fixed lower members 2 with the speed and displacement corresponding to the speed command.

The limit value of the relative displacement of the upper members 4 with the weight 5 mounted thereon as well as the limit value of the torque of the motor are calculated by and stored in advance in the computer 27. In a range in which each of these limit values is not exceeded, the servo motor 15 of the active vibration-damping unit B is driven in response to the command signal, as described above, to effect active damping. However, if the relative displacement and the velocity exceed the limit values, the driving of the servo motor 15 of the active vibration-damping unit B is stopped and the servo motor 15 is set in a no-load state, and the vibration is suppressed by the passive vibration-damping unit A.

When the upper members 4 of the passive vibration-damping unit A shake in the longitudinal direction with the servo motor 15 set in the no-load state, the roller members 3, which are interposed between the upwardly-oriented concave arcuate surfaces 6 of the fixed lower members 2 and the downwardly-oriented concave arcuate surfaces 10 of the upper members 4, roll, so that the upper members 4 swing in a shaking manner relative to the lower members 2. At this juncture, with respect to the movement in the horizontal direction, the pair of pins 18 of the connecting member 19, which are fitted in the pair of bearing members 24 secured to the frame 12 of the passive vibration-damping unit A, are moved by the movement of the upper members 4. With respect to the movement in the vertical direction, the bearing members 24 slide vertically in the fitted portions relative to the pins 18, thereby absorbing the difference in vertical displacement. When the connecting member 19 which is connected to the upper members 4 is moved in the longitudinal direction, the nut member 17 affixed at a lower end of the member 19 is also moved together with the members 4 while rotating the ball screw 16.

In this case, the shaking range of the upper members 4 in the longitudinal direction becomes large due to the large-scale vibration of the building C. However, when the upper members 4 have shaken in the longitudinal direction up to a maximum limit with respect to the lower members 2, opposite end faces of the connecting member 19 respectively abut against the stoppers 14 on both sides, thereby preventing further shaking movement. Thus, the operation is continued to suppress the vibration of the building C passively without the dislocation of the upper members 4 from the lower members 2.

When the magnitude of the vibration of the building C has become smaller than the aforementioned level of magnitude, and the amplitude of the weight has subsided to a level which permits active control on the continuous basis, the amount of amplitude thereof (relative velocity and displacement) is detected by the sensor 25, and the power supply of the servo motor 15 is turned on again, thereby suppressing the vibration of the building C through active damping. Thus, if the power supply of the servo motor 15 is turned on before a state which permits continuous active damping, i.e., when the amount of amplitude of the weight has become slightly small, then the limit value of displacement is reached immediately due to the change in the vibrating state of the building C, and the power supply of the servo motor 15 is turned off. Since such control is wasteful, an arrangement is actually provided such that the control mode is shifted to active damping when ⅕ to ⅓ of the displacement limit has been reached.

As described above, in accordance with the method of damping in accordance with the present invention, the arrangement provided is as follows: There are provided a passive vibration-damping unit including a lower member fixed integrally on a building, and a weight mounted on the upper member relatively movable in the vibrating direction of the building, an amount of movement of the weight being restricted by a stopper member in a range in which the weight is not dislocated from the lower member, and an active vibration-damping unit for moving the weight of the passive vibration-damping unit in a damping direction with respect to the lower member. The active vibration-damping unit is operated with a control force corresponding to the velocity of the vibration and displacement of the building when the building is vibrated. The operation of the active vibration-damping unit is stopped and only the passive vibration-damping unit is operated when relative displacement of the active vibration-damping unit with respect to the vibration or a torque of the motor has reached a limit value. Accordingly, since the operation of this active vibration-damping unit is stopped, and only the passive vibration-damping unit is operated, it is possible to control the vibration of the building forcibly by an optimum control force with the velocity and displacement of the active vibration-damping unit corresponding to the magnitude of the vibration of the building. Thus it is possible to provide vibration damping effectively with respect to vibrations ranging from the stage of small vibrations to a higher mode.

Furthermore, when the relative displacement of the active vibration-damping unit or the torque of the motor has reached a limit value due to the large-scale vibration of the building, the operation of this active vibration-damping unit is stopped, and only the passive vibration-damping unit is operated. Therefore, since it is possible to perform active damping by the active vibration-damping unit up to the limit of the capacity of the active vibration-damping unit, and the active vibration-damping unit is stopped at a level exceeding that limit, it is possible to obviate failure or damage caused by a state of overload of the active vibration-damping unit. Moreover, the vibration of the building can be attenuated reliably by continuing the operation of the passive vibration-damping unit. In this case, the shaking movement of the passive vibration-damping unit may become very large, but since the movable section is prevented from being dislocated from the lower members by means of the stopper members and the like, it is possible to ensure the safety of the overall apparatus and continued damping.

In addition, in accordance with the present invention, since the active vibration-damping unit is operated again when the relative displacement of the active vibration-damping unit with respect to the vibration or the torque of the motor has dropped below the limit value and when continuous active damping is possible, the vibration damping apparatus is capable of demonstrating positive and effective damping operation until the vibration of the building subsides.

Furthermore, in accordance with the vibration damping apparatus of the present invention, the active vibration-damping unit is arranged such that the motor is fixed to the building or the lower members, the ball screw is disposed horizontally along the vibrating direction of the building, the ball screw being rotated by the activation of the motor, and the connecting member has the nut member meshing with the ball screw and is engaged with the upper member in such a manner as to be capable of undergoing relative movement in a vertical direction. Accordingly, when the ball screw is rotated in the forward direction or in the reverse direction in response to a speed command signal from a control circuit, the movable section of the passive vibration-damping unit can be operated smoothly by means of the nut member. In addition, even if the motor of the active vibration-damping unit is stopped, the nut member is moved smoothly along the ball screw while rotating the ball screw, so that the vibration of the building can be reliably suppressed by only the passive vibration-damping unit.

What is claimed is:

1. A method of damping the vibration of a building, comprising the steps of:

providing a passive vibration-damping unit including a lower member fixed integrally on a building and having on its upper surface an upwardly-oriented concave arcuate surface, an upper member having on its lower surface a downwardly-oriented concave arcuate surface, said upper member being placed on the upwardly-oriented concave arcuate surface of said lower member with a roller member interposed therebetween, such that said upper member is capable of moving in a shaking manner in a vibrating direction of the building, and a weight mounted on said upper member, an amount of movement of said weight being restricted by a stopper member in a range in which said weight is not dislocated from said lower member, and an active vibration-damping unit having a motor for moving said weight of said passive vibration-damping unit in a damping direction with respect to said lower member in response to driving said motor;

operating said active vibration-damping unit, including driving said motor to move said weight of said passive vibration-damping unit, with a control force corresponding to the velocity of the vibration and displacement of the building when the building is vibrated; and stopping the operation of the motor of said active vibration-damping unit and operating only said passive vibration-damping unit when one of (1) a relative displacement of said weight to the lower member by means of said active vibration-damping unit, and (2) a torque of said motor required for the displacement of said weight has reached a given limit value.

2. A method of damping the vibration of a building, comprising the steps of:

providing a passive vibration-damping unit including a lower member fixed integrally on a building and having on its upper surface an upwardly-oriented concave arcuate surface, an upper member having on its lower surface a downwardly-oriented concave arcuate surface, said upper member being placed on the upwardly-oriented concaved arcuate surface of said lower member with a roller member interposed therebetween, such that said upper member is capable of moving in a shaking manner in a vibrating direction of the building, and a weight mounted on said upper member, an amount of movement of said weight being restricted by a stopper member or the like in a range in which said weight is not dislocated from said lower member, and an active vibration-damping unit having a motor for moving said weight of said passive vibration-damping unit in a damping direction with respect to said lower member by means of driving of the motor;

operating said active vibration-damping unit, including driving said motor to move said weight of said passive vibration-damping unit, with a control force corresponding to the velocity of the vibration and displacement of the building when the building is vibrated;

stopping the operation of the motor of said active vibration-damping unit and operating only said passive vibration-damping unit when one of (1) a relative displacement of said weight to the lower member by means of said active vibration-damping unit, and (2) a torque of said motor required for the displacement of said weight has reached a given limit value; and operating the motor of said active vibration-damping unit again when the relative displacement of said weight to the lower member by means of said active vibration-damping unit and the torque of said motor required on the displacement of said weight has dropped below the limit value and when continuous active damping is possible.

3. An apparatus for damping the vibration of a building, comprising:

a passive vibration-damping unit including a lower member fixed on a building and having on its upper surface an upwardly-oriented concave arcuate surface, an upper member having on its lower surface a downwardly-oriented concave arcuate surface, said upper member being placed on the upwardly-oriented concave arcuate surface of said lower member with a roller member interposed therebetween, such that said upper member is capable of moving in a shaking manner, a weight mounted on said upper member, and a stopper member provided at each opposite end of said lower member for restricting the shaking range of said upper member;

an active vibration-damping unit including a motor fixed to at least one of the building and said lower member, a ball screw disposed horizontally in a vibrating direction of the building, said ball screw being rotated by an activation of said motor, and a connecting member having a nut member meshing with said ball screw, said connecting member being engaged with said upper member in such a manner as to be capable of undergoing relative movement in a vertical direction;

a vibration detecting sensor disposed at an appropriate position in the building and a movable section of said passive vibration-damping unit; and a control circuit for computing an optimum damping speed on the basis of values of measurement from said vibration detecting sensor so as to drive said motor of said active vibration-damping unit in a vibration suppressing direction.

* * * * *

UNITED STATES PATENT AND TRADEMARK OFFICE

CERTIFICATE OF CORRECTION

PATENT NO. : 5,544,452

DATED : August 13, 1996

INVENTOR(S) : TAKAFUMI FUJITA; IKUO SHIMODA; MASAMI MOCHIMARU; SUSUMU OTSUKA; NOBUYASU KAWAI; MASAHIRO KURIMOTO; KANEMASA INABA

It is certified that error appears in the above-identified patent and that said letters patent is hereby corrected as shown below:

On the title page: Item [75]

"Kurimoto Kurimoto" should read --Masahiro Kurimoto--.

Signed and Sealed this

Tenth Day of December, 1996

*Attest:*

Bruce Lehman

BRUCE LEHMAN

*Attesting Officer*

*Commissioner of Patents and Trademarks*